United States Patent [19]

Kaelin

[11] Patent Number: 5,043,958

[45] Date of Patent: Aug. 27, 1991

[54] PUSH BUTTON ASSEMBLY PARTICULARLY FOR A WATCHCASE

[75] Inventor: Laurent Kaelin, Bienne, Switzerland

[73] Assignee: ETA SA Fabriques d'Ebauches, Switzerland

[21] Appl. No.: 498,643

[22] Filed: Mar. 26, 1990

[30] Foreign Application Priority Data

Apr. 12, 1989 [CH] Switzerland ..... 01377/89

[51] Int. Cl.[5] ..... G04B 29/00

[52] U.S. Cl. ..... 368/321; 368/319

[58] Field of Search ..... 368/319-321, 368/276-300

[56] References Cited

U.S. PATENT DOCUMENTS

| | | | |
|---|---|---|---|
| 4,104,866 | 8/1978 | Chappatte | 368/321 |
| 4,118,923 | 10/1978 | Bourquard | 368/319 |
| 4,346,464 | 8/1982 | Wenger | 368/319 |
| 4,408,901 | 10/1983 | Gagnebin | 368/319 |
| 4,451,719 | 5/1984 | Lauterburg et al. | 368/321 |

FOREIGN PATENT DOCUMENTS

| | | | |
|---|---|---|---|
| 0284899 | 1/1988 | European Pat. Off. . | |
| 2641928 | 3/1977 | Fed. Rep. of Germany | 368/319 |
| 3309321 | 11/1984 | Fed. Rep. of Germany . | |
| 2030095 | 4/1970 | France . | |
| 2344882 | 8/1977 | France . | |
| 642 | 8/1975 | Switzerland . | |
| 3304 | 10/1976 | Switzerland . | |
| 594924 | 6/1978 | Switzerland . | |
| 621453 | 7/1981 | Switzerland . | |

OTHER PUBLICATIONS

Swiss Search Report for corresponding Swiss Application No. CH 1377/89 and listing of corresponding patent documents.

*Primary Examiner*—Bernard Roskoski

*Attorney, Agent, or Firm*—Pollock, Vande Sande & Priddy

[57] ABSTRACT

The watch case (1) is of plastic material and provided with a hole (3) in which a push button (6) may slide. The end (12) of the stem (7) of the push button includes a bulge (13) the diameter of which is greater than that of the neck (11) formed at the end of the hole opening into the interior of the case (1). When the stem (7) is introduced into the hole (3) of the wall (2) the bulge (13) elastically deforms the neck (11) which afterwards reassumes its initial form and assures axial positioning of the stem (7).

19 Claims, 1 Drawing Sheet

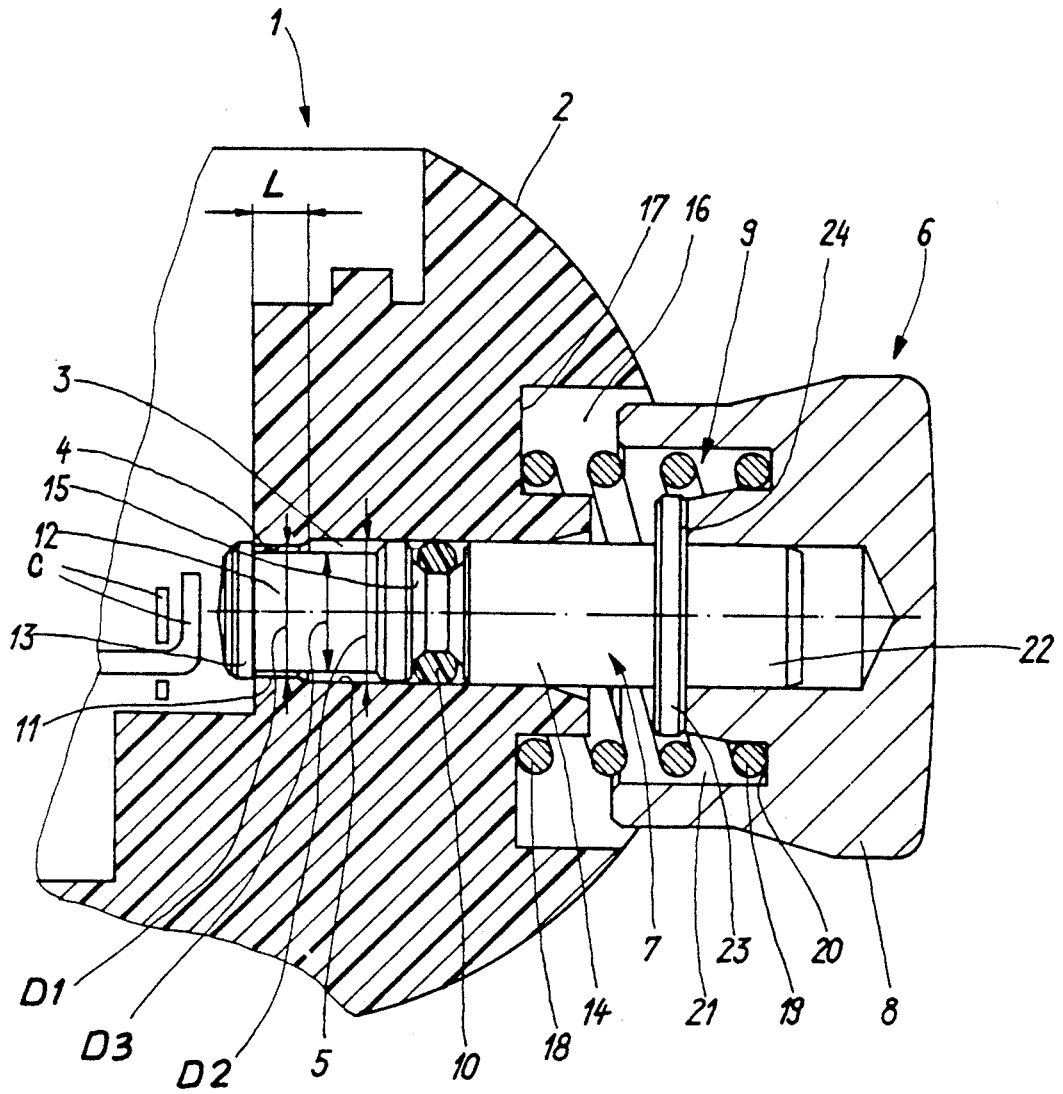
1
2
L
17
16
9
24
6
3
4
15
12
C
13
11
22
D1
D3
D2
5
10
18
14
7
21
23
19
20
8

PUSH BUTTON ASSEMBLY PARTICULARLY FOR A WATCHCASE

This invention concerns a push button intended for the transmission of a mechanical force through a wall which latter could in particular be the wall of a watch case.

BACKGROUND OF THE INVENTION

Already known from Swiss patent CH 594 924 is a push button for timepieces comprising a stem, a return spring and a moisture seal, the whole being inserted in a guide socket intended to be secured in the case of a timepiece. The portion of the socket situated on the interior of such case ends with an opening bounded by an annular flange of tapered form. This flange is elastic and permits the passage through the opening of the end portion of the stem. Such end portion exhibits an outer diameter substantially greater than the diameter of the opening. Thus the stem may be axially positioned in the socket, the return spring being concentrically arranged on the stem and being directly supported on the moisture seal, the latter being confined between the spring and the end flange of the socket.

This construction operates in a satisfactory manner but exhibits in particular the difficulties of requiring a number of manipulations and pre-assembly operations which render impossible the manufacture of such push buttons at a low price.

The push button described in the Swiss patent CH 621 453 constitutes an attempt to overcome the difficulties cited above.

This push button includes a stem in three parts, a return spring and a moisture seal arranged directly in a hole provided in a wall of a support receiving the push button. The hole opens into the interior of the support through a constriction. The inner portion of the stem passes through such constriction and terminates with a flange having a cylindrical exterior surface with a diameter substantially greater than the diameter of the constriction this inner portion being axially split. Thus, when the stem is inserted in the hole in the wall, the inner portion with its flange is radially deformed by elastic squeezing at the passage of the constriction, after which it reassumes its initial form, the flange assuring axial maintenance of the stem.

This construction has the advantage of eliminating the utilization of the guiding socket provided in the construction proposed in Swiss patent CH 594 924. Nevertheless, it still presents certain difficulties. Effectively, a stem in three portions as in the Swiss patent CH 621 453 must be machined on a profiling lathe and in order thereafter to machine the axial slot in the inner portion of the stem, it is necessary to stop the lathe and to employ a special tool. There thus results an increase in the time and the cost of manufacture.

Furthermore, the machining of such a slot brings the risk of forming burrs which may hinder the putting into place of the stem such that there must be provided an additional operation of burr removal.

The invention thus has as its purpose to overcome the difficulties brought about by the prior art and to furnish a push button which is simple to obtain and easy to assemble.

SUMMARY OF THE INVENTION

To this end, the invention has as its object a push button intended to set off an action from a first side of a wall originating from a second side of the latter, the wall adapted to be in particular that of a watch case, said wall exhibiting a hole having at least a first portion of a first diameter opening from said first side and extending over a limited length in order to define a neck and a second portion of a second diameter greater than said first diameter and opening from said second side, said push button comprising a stem ending with a bulge at the first side of the wall and means for returning said stem to a rest position.

In conformity with the invention, the wall is formed of synthetic material, the neck is elastically deformable and the bulge on the stem is non-deformable, and exhibits a diameter in between that of the first and second diameters of the hole so that when the stem is introduced into the hole in the wall, the bulge elastically deforms the neck which, following passage of the bulge, reassumes its initial form thus assuring an axial positioning of the stem.

Thanks to these characteristics, one may advantageously employ the intrinsic elastic properties of the synthetic material in order to obtain a push button which may not be removed and which unites reliability to simplicity of production, this whilst diminishing its cost price.

According to an advantageous characteristic of the invention, the bulge on the stem is connected via a portion of the stem of small diameter to another portion of the stem adjusted to sliding fit in the second portion of the hole in order to assure guiding of the stem in the wall.

Thanks to this characteristic, one avoids the creation of lateral clearance of the stem in the wall so that one eliminates all risk of enlarging the neck following prolonged utilization of the push button under poor conditions of stem guidance. There accordingly results therefrom that an untimely separation of the push button from the wall is avoided and consequently the life expectancy of the push button is increased.

Other characteristics and advantages of the invention will appear from the description to follow of a non-limiting embodiment of the invention taken together with the single figure which represents a partial cross-section of an example of an embodiment of a push button according to the invention applied to a watch case.

DESCRIPTION OF THE PREFERRED EMBODIMENT

Referring to the figure, one will see a watch case generally designated by reference 1. This watch case comprises a caseband 2 integrally formed with the case. The wall of the caseband 2 is provided with a hole 3 opening into the interior of the case. This hole 3 comprises a first portion 4 having a first diameter D1 which opens directly to the interior of the case and a second portion 5 having a second diameter D2 greater than the first and opening to the outer side of the case.

Furthermore, the caseband 2 is provided with a push button 6 enabling the transmission of mechanical force from the exterior of the case towards the interior, for example in order to operate a contact C for controlling the display of information such as the date or the like.

This push button essentially comprises a stem 7, a crown 8, a return spring 9 for returning the push button to a rest position (shown on the figure) and a moisture seal 10.

According to the invention, the caseband is formed of synthetic material and preferably the material employed has a structure exhibiting a large zone of elastic deformation. One may refer advantageously among materials possessing these characteristics to the amorphous type of synthetic materials and more particularly the acrylic butadiene styrene family designated currently as ABS.

Furthermore, the first portion 4 of the hole 3 extends over a limited length L and defines a neck 11. According to the invention, the stem 7 comprises an intermediate portion 12 which is solid and undeformable and terminates with a bulge 13 having a diameter greater than the diameter D1 of the first portion 4 of the hole 3 and less than the diameter D2 of the second portion 5. The intermediate portion 12 has a diameter D3 less than the diameter D1 of the first portion 4.

Thus, when the stem 7 is introduced into hole 3 in the caseband 2, the bulge 13 exerts pressure on the neck 11 so that this is elastically deformed and permits passage of the bulge, following which the neck reassumes its initial form whilst assuring axial positioning of the stem.

It will be noted that the limited length of the first portion 4 defining the neck is chosen as a function of the diameter of the latter and preferably the ratio L/D1 will be comprised between 0.3 and 0.4.

According to an advantageous characteristic of the invention, the intermediate portion 12 of stem 7 is connected to a portion of stem 14 adjusted to slide on the second portion 5 of the hole 3 in order to assure correct guiding of the stem 7 and consequently of the push button in the caseband.

This portion of stem 14 comprises an annular housing 15 which receives the moisture seal 10 of the "0 ring" type in the example as shown. It is noted that in this embodiment and in an advantageous manner the moisture seal is not subjected to compression stresses as is the case in the prior art cited where it is interposed between two movable elements and where it participates in the transmission of the force exerted on the push button. There thus results that its life expectancy is substantially increased.

It will be likewise noted in this case that in order to facilitate fabrication of the stem as well as its setting into place in the caseband, the bulge will be provided with a diameter identical to that of the portion of the stem 14 serving as guide.

In the embodiment shown, the caseband 2 comprises furthermore an annular groove 16 centered around hole 3. This groove 16 partially receives the crown 8 in its rest position, in order to avoid that the crown be removed from its housing and consequently that the push button 6 be disconnected from caseband 2 in the case of untimely application of force to the base of crown 8.

Furthermore, the bottom 17 of groove 16 defines a support surface for an end 18 of the return spring 9. The opposite end 19 of this latter is supported against the bottom 20 of an annular groove 21 provided in the crown 8 and defining an annular skirt and forming thus a housing for receiving the return spring.

Finally, in the example shown on the figure, crown 8 is driven onto a shank 22 of stem 7 and is supported on a flange 23 defining a support surface 24. It is well understood that the crown and the stem may be formed integrally in order to diminish the number of parts of the whole.

It is well understood that the invention is not limited to application of the push button to a watch case. It may effectively and advantageously find application in all cases where a mechanical effort must be transmitted through a wall of synthetic material by a push button.

What I claim is:

1. A push button assembly comprising a wall forming a part of a watch caseband, and a push button for transmitting a mechanical force from a second side of said wall to a first side of said wall, said wall being formed from a synthetic material and having a hole, said hole comprising a first portion of a first diameter opening from said first side and extending over a limited length in order to define a neck, and a second portion of a second diameter greater than said first diameter opening from said second side;

said push button comprising a stem having a bulge at said first side of said wall, said bulge on said stem being connected through a portion of said stem of smaller diameter to a guiding portion of said stem having a diameter to slidingly fit in said second portion of said hole so as to assure guiding of said stem for axial movement in said wall, and means for returning said stem to a rest position in which said bulge rests against an edge portion of said neck at said first side of said wall; and, said neck being elastically deformable and said bulge being non-deformable and exhibiting a diameter in between that of said first and second diameters of said hole so that when said stem is introduced into said hole in said wall said bulge elastically deforms said neck which, following passage of said bulge, reassumes its initial form to assure axial positioning of said stem in said rest position.

2. A push button assembly as set forth in claim 1 wherein said stem comprises a crown capping an end of said stem on said second side of said wall, said crown comprising a first annular groove centered on said stem and facing said wall, and said wall further comprising a second annular groove centered on said hole, said first and second grooves defining a housing for receiving said returning means.

3. A push button assembly as set forth in claim 2 wherein said first annular groove is formed in said crown at its base and defines a skirt which penetrates partially into said second annular groove in said wall when said stem is in said rest position.

4. A push button assembly as set forth in claim 2 wherein each of said first and second annular grooves comprises a bottom, each of said bottoms forming a support surface, and wherein the returning means comprises two ends, each of said ends resting on a corresponding one of said support surfaces.

5. A push button assembly as set forth in claim 2 wherein said stem comprises a shank and a flange defining a supporting surface, said crown being driven onto said shank and supported on said supporting surface of the flange.

6. A push button assembly as set forth in claim 1 wherein said stem comprises an annular housing, said annular housing being provided in said guiding portion of said stem, and wherein said push button assembly further comprises a moisture seal arranged in said annular housing.

7. A push button assembly as set forth in claim 1 wherein said wall is formed from a synthetic material forming part of the acrylic butadiene styrene family.

8. A push button assembly as set forth in claim 1 wherein said returning means comprises a helical spring.

9. A push button assembly as set forth in claim 2 wherein said returning means comprises a helical spring.

10. A push button assembly as set forth in claim 3 wherein said returning means comprises a helical spring.

11. A push button assembly as set forth in claim 4 wherein said returning means comprises a helical spring.

12. A push button assembly as set forth in claim 1 wherein the ratio of said limited length of the neck to said first diameter of the neck is between 0.03 and 0.4.

13. A push button assembly as set forth in claim 1 wherein the diameter of said bulge is substantially the same as the diameter of said guiding portion of the stem.

14. A watchcase comprising:

a wall forming a part of a caseband of the watchcase and formed from a synthetic material, said wall having a hole comprising a first portion of a first diameter opening from a first side of said wall and extending over a limited length in order to define a neck, and a second portion of a second diameter greater than said first diameter opening from a second side of said wall; and, a push button for transmitting a mechanical force from said second side of said wall to said first side of said wall, said push button comprising a stem having a bulge at said first side of said wall, said bulge on said stem being connected through a portion of said stem of smaller diameter to a guiding portion of said stem having a diameter to slidingly fit in said second portion of said hole so as to assure guiding of said stem for axial movement in said wall, and means for returning said stem to a rest position in which said bulge rests against an edge portion of said neck at said first side of said wall, said neck being elastically deformable and said bulge being non-deformable and exhibiting a diameter in between that of said first and second diameters of said hole so that when said stem is introduced into said hole in said wall said bulge elastically deforms said neck which, following passage of said bulge, reassumes its initial form to assure axial positioning of said stem in said rest position.

15. A watchcase as set forth in claim 14 wherein said stem comprises a crown capping an end of said stem on said second side of said wall, said crown comprising a first annular groove centered on said stem and facing said wall, and said wall further comprising a second annular groove centered on said hole, said first and second grooves defining a housing for receiving said returning means.

16. A watchcase as set forth in claim 15 wherein said first annular groove is formed in said crown at its base and defines a skirt which penetrates partially into said second annular groove in said wall when said stem is in said rest position.

17. A watchcase as set forth in claim 15 wherein each of said first and second annular grooves comprises a bottom, each of said bottoms forming a support surface, and wherein the returning means comprises two ends, each of said ends resting on a corresponding one of said support surfaces.

18. A watchcase as set forth in claim 15 wherein said stem comprises a shank and a flange defining a supporting surface, said crown being driven onto said shank and supported on said supporting surface of the flange.

19. A watchcase as set forth in claim 14 wherein said stem comprises an annular housing, said annular housing being provided in said guiding portion of said stem, and wherein said push button further comprises a moisture seal arranged in said annular housing.

* * * * *